US007682149B2

(12) United States Patent
Wade

(10) Patent No.: US 7,682,149 B2
(45) Date of Patent: Mar. 23, 2010

(54) TIMED WICK AND CANDLE THEREOF

(76) Inventor: Travis Aaron Wade, 12400 Ventura Blvd #903, Studio City, CA (US) 91604

( * ) Notice: Subject to any disclaimer, the term of this patent is extended or adjusted under 35 U.S.C. 154(b) by 0 days.

(21) Appl. No.: 11/850,668

(22) Filed: Sep. 5, 2007

(65) Prior Publication Data

US 2008/0057452 A1 Mar. 6, 2008

Related U.S. Application Data

(60) Provisional application No. 60/824,465, filed on Sep. 5, 2006.

(51) Int. Cl.
*F23D 3/18* (2006.01)

(52) U.S. Cl. ..... 431/325; 431/33; 431/288

(58) Field of Classification Search ..... 431/33, 431/288, 325

See application file for complete search history.

(56) References Cited

U.S. PATENT DOCUMENTS 3,123,102 A * 3/1964 Frieder et al. ..... 138/125
3,753,654 A * 8/1973 Eggertsen ..... 436/154
4,459,131 A * 7/1984 Cremonese ..... 44/507
4,503,322 A * 3/1985 Kishimoto et al. ..... 219/505
5,153,553 A * 10/1992 Ruehl et al. ..... 337/273
5,961,967 A * 10/1999 Powell et al. ..... 424/76.4
6,447,286 B1 9/2002 Snuggs
6,507,264 B1 * 1/2003 Whitney ..... 337/159
6,645,637 B2 * 11/2003 Kaltenborn et al. ..... 428/447
6,652,269 B1 * 11/2003 Stenger ..... 431/325
6,805,551 B1 10/2004 Feuer
6,823,548 B2 * 11/2004 Murphy et al. ..... 5/698
7,040,888 B2 5/2006 Keiffer et al.
2002/0004547 A1 * 1/2002 Kaltenborn et al. ..... 524/442
2003/0124474 A1 7/2003 Elliott, III
2004/0091829 A1 5/2004 Mack
2006/0019209 A1 1/2006 Ortiz, Jr.

FOREIGN PATENT DOCUMENTS

JP 2000253867 A * 9/2000

* cited by examiner

*Primary Examiner*—Kenneth B Rinehart
*Assistant Examiner*—Jorge Pereiro
(74) *Attorney, Agent, or Firm*—George R. Reardon

(57) ABSTRACT

A powered, mechanical teeth cleaning device having two lines of rotating brushes is disclosed. The brushes rotate inwardly from each side, giving a cleaning effect on both buccal and lingual surface of the tooth from the gum tissue to the tooth direction. A protective shield for minimizing tissue irritation, a guiding stop for proper tooth positioning and a brush direction-of-rotation switch are included.

9 Claims, 3 Drawing Sheets

TIMED WICK AND CANDLE THEREOF

This application claims priority to provisional application 60/824,465, filed on Sep. 5, 2006, which is incorporated in its entirety herein.

FIELD OF THE INVENTION

The technology disclosed herein relates generally to the field of candle wicks and candles and methods of making the same, consisting essentially of a wick designed with the ability to automatically extinguish a flame in equal-time intervals. This process repeats itself over the life cycle of the wick.

BACKGROUND OF THE INVENTION

The purpose of a candle wick is to provide a candle with a flame. The heat from the flame melts the wax surrounding the base of the wick directly beneath it. The melted wax is then drawn up within the wick providing fuel for the flame. The candle continues to burn through an ongoing cycle. Wax in solid state is melted by the heat of the flame and converts to a liquid state. The liquid wax is drawn up to the top of the wick inside the flame and continues the burning process. The cycle repeats itself until the wick is no longer functioning due to lack of fuel for the flame.

Candles have been used for many years and for many different reasons, the reasons vary depending on the user. Today, a large number of candles are purchased simply for their pleasant fragrances and decorative appearance. The aromatherapy derived from a candle is widely used as well. It entices the user to relax and forget about everyday responsibilities.

However, one problem that exists between the user and the candle is that the user neglects to extinguish the candle. People today are simply to busy to remember to blow out a candle prior to leaving their homes. Panic sets in. A candle equipped with a wick that will automatically extinguish a candle flame in equal-time intervals would provide a user with the security of knowing that their candle will self extinguish in a short period of time.

Another problem that exists today is the vast number of house fires caused by leaving a candle unattended. The average burning time for a candle may be 60 to 95 hours. This time period is too long since it creates a greater risk of the candle being knocked over by a house pet, wind, or even a small child. Limiting the amount of burning time from 1 to 4 hours could significantly reduce the risk of house fires.

Known art related to timed candles includes U.S. Pat. Nos. 6,447,286, 6,805,551, 7,040,888, 2003/0124474, 2004/0091829, and 2006/0019209.

While these patents and other previous methods have attempted to solve the problems that they addressed, none address using a combustible material to self-extinguish a candle, as does embodiments of the technology disclosed herein.

Therefore, a need exists for a timed wick and candle with these attributes and functionalities. The timed wick and candle according to embodiments of the invention substantially departs from the conventional concepts and designs of the prior art. It can be appreciated that there exists a continuing need for a new and improved timed wick and candle which can be used commercially. In this regard, the technology disclosed herein substantially fulfills these objectives.

The foregoing patent and other information reflect the state of the art of which the inventor is aware and are tendered with a view toward discharging the inventor's acknowledged duty of candor in disclosing information that may be pertinent to the patentability of the technology disclosed herein. It is respectfully stipulated, however, that the foregoing patent and other information do not teach or render obvious, singly or when considered in combination, the inventor's claimed invention.

BRIEF SUMMARY OF THE INVENTION

The general purpose of the technology disclosed herein, which will be described subsequently in greater detail, is to provide a timed wick and candle.

According to its major aspects and briefly described, the technology disclosed herein is a system of components that cooperate with each other to create a candle that will burn for a predetermined amount of time, e.g. 1 hour, 2 hours, etc., self-extinguish via a combustible substance, and be capable of being relit after self-extinguishing.

The general purpose of the present invention, which will be described subsequently in greater detail, is to provide a timed wick. The timed wick is designed to interrupt the burning process in a timed interval by rapidly vaporizing a wick segment.

In one embodiment this is accomplished by interspersing a length of a rapidly combustible area along the length of a conventional wick. Thus the timed wick is comprised of conventional wick segments linked with rapidly combustible wick segments. The rapidly combustible wick segment may be impregnated with compositions such as magnesium, sulfate, and the like.

Depending on the embodiment applied beaded wick technology and/or injection wick technology may be used to form the timed wick.

When the flame of the wick reaches the rapidly combustible wick segment a spark occurs with sufficient intensity so that the flame is extinguished due to the vaporization of the wick segment, thus stopping the flame from receiving the next conventional wick segment that it needs to continue the burning process. The intervals of normal burning prior to the extinguishing of the flame can be tailored to be of substantially equal periods, e.g. 1 hour. The equal-time intervals can be altered by increasing or decreasing the length of the conventional wick. Thus a candle that self-extinguishes in 2 hours, 3 hours, 4 hours, etc. may be constructed.

In one embodiment of the present invention, the rapidly combustible wick segment may be formed by a spirally winding a rapidly combustible composition around a former heat set and then threaded within a conventional wick. In another embodiment of the present invention, a conventional wick is treated with a rapidly combustible composition. In yet another embodiment of the present invention, a rapidly combustible composition is injected into a conventional wick.

One aspect of the technology disclosed herein is that it self-extinguishes after a predetermined time.

Another aspect of the technology disclosed herein is that it is capable of being relit using conventional candle lighting methods.

Another aspect of the technology disclosed herein is that it is easy to use.

Another aspect of the technology disclosed herein is that it can be made inexpensively.

Another aspect of the technology disclosed herein is that it can be made from readily available materials.

Another aspect of the technology disclosed herein is that it can be used in a commercial or residential environment.

These and other features and advantages of the technology disclosed herein will be presented in more detail in the following specification of the invention to illustrate the principles of the technology disclosed herein.

There are additional features of the invention that will be described hereinafter and which will form the subject matter of the claims to be appended hereto. In this respect, before explaining at least one embodiment of the invention in detail, it is to be understood that the invention is not limited in its application to the details of construction and to the arrangements of the components set forth in the following description or illustrated in drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the technology disclosed herein. It is important, therefore, that claims be regarded as including such equivalent constructions insofar as they do not depart from the spirit and scope of the technology disclosed herein.

BRIEF DESCRIPTION OF THE SEVERAL VIEWS OF THE DRAWINGS

The technology disclosed herein, together with further advantages thereof, may best be understood by reference to the following description of the simplest form of the technology disclosed herein, taken in conjunction with the accompanying drawings in which.

DETAILED DESCRIPTION OF THE INVENTION

The technology disclosed herein will now be described in detail with reference to a few preferred embodiments. In the following description, numerous specific details are set forth in order to provide a thorough understanding of the technology disclosed herein. It will be apparent, however, to one skilled in the art, that the technology disclosed herein may be practiced without some or all of these specific details. In other instances, well known operations have not been described in detail so not to unnecessarily obscure the technology disclosed herein.

Figure 1:
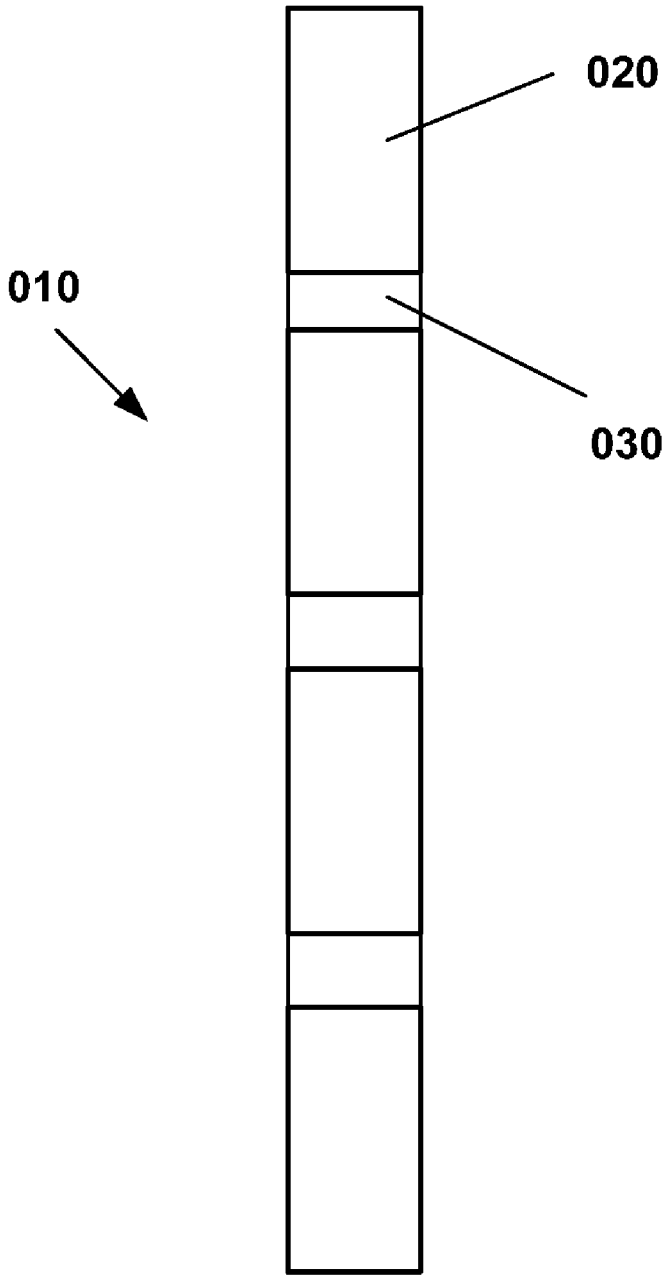
FIG. 1 illustrates a timed wick structure, according to an embodiment of the technology disclosed herein.
Figure 2:
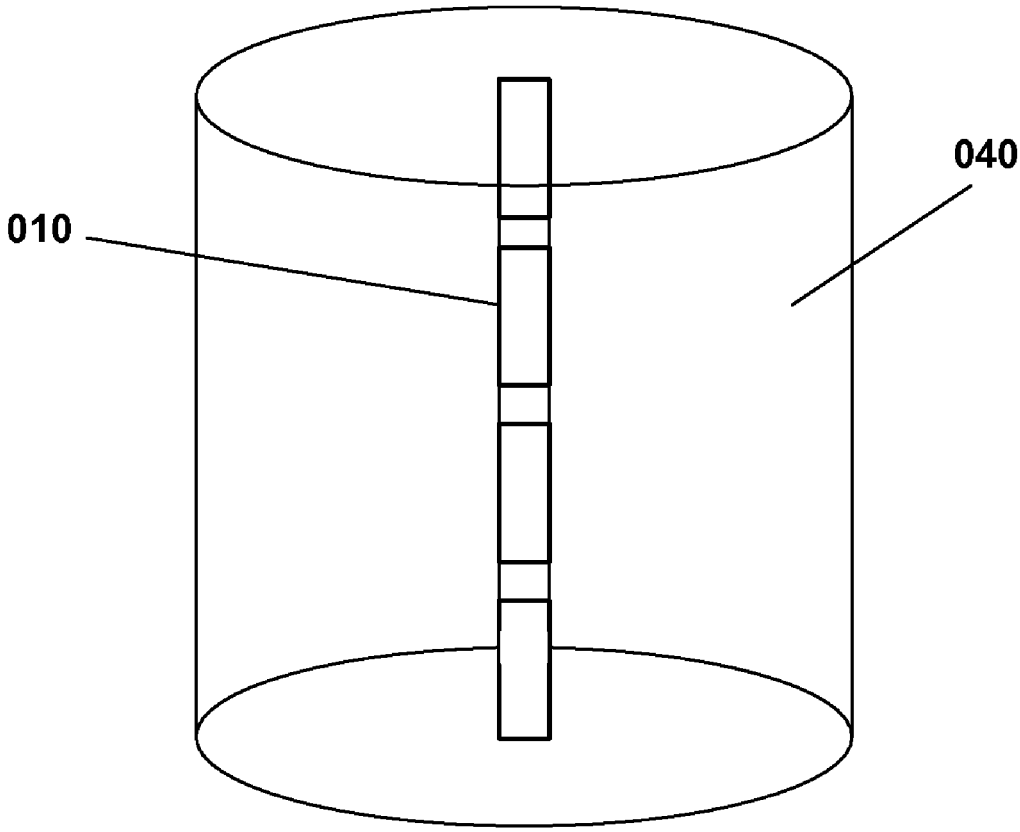
FIG. 2 illustrates a candle having a timed wick structure, according to an embodiment of the technology disclosed herein.
Figure 3A:
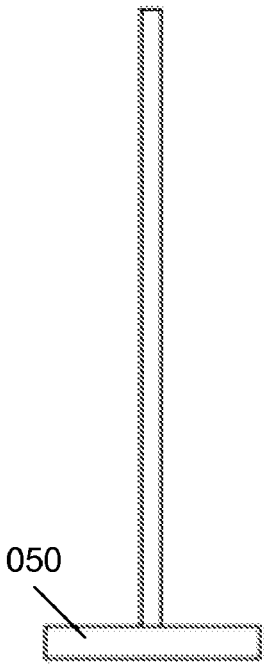
FIG. 3A illustrates a wick secured in a base prior to having a combustible substance applied, according to an embodiment of the technology disclosed herein.
Figure 3B:
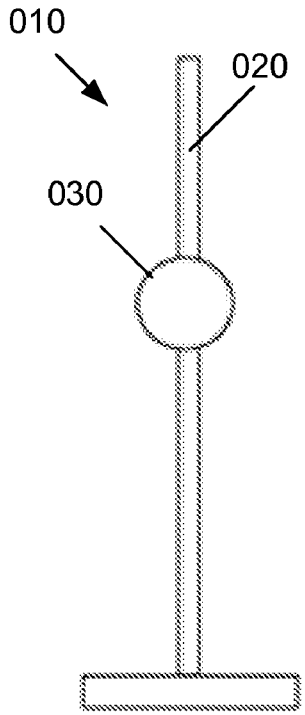
FIG. 3B illustrates a combustible spherical substance applied to a wick, according to an embodiment of the technology disclosed herein.
Figure 3C:
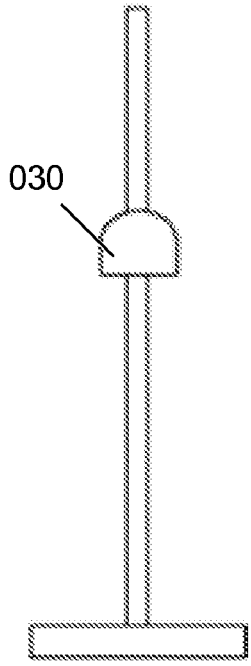
FIG. 3C illustrates a combustible non-spherical substance applied to a wick, according to an embodiment of the technology disclosed herein.

Referring now to FIGS. 1-3C, in an exemplary embodiment a timed wick 010 is comprised of a plurality of a wick segment 020 separated by combustible segment 030. The timed wick may be secured to a base 050 prior to candle wax 040 being formed around the timed wick 010 to form a timed candle.

The technology disclosed herein is directed to creating timed intervals within a candle such that upon completing an interval the candle self-extinguishes, yet is able to be relit without having to physically remove a non-combustible barrier. Rather than physically removing a barrier, the barrier itself consists of a combustible material that upon additional heat, chemically changes, allowing continued burning of the candle. The combustible material acts to both initially extinguish the burning candle and then combusts to allow continued burning of the candle.

In one embodiment the timing mechanism consists of varied amounts of magnesium metal present throughout the wick segment. The varying amounts of magnesium physically changes the burning characteristics of a candle, resulting in the desired extinguishing with the ability to re-light at a later time, starting a new timed interval designed into the candle.

A second embodiment does not require complete treatment of the wick, but instead allows for the treatment of only the end of intervals within the candle body, positioning the timing mechanism on and around various wick segments. The positioning of the combustible substance is referred to as wick treatment, but is not limited to placing a substance on the wick segment, e.g. the combustible substance may be infused into the wick. Using the magnesium calls for incorporation of the substance within the wick, and various other embodiments may require a contribution from the additives or wax type contained within the candle not just the wick.

In both of these embodiments the end result is the use of a timing mechanism that causes a candle to self-extinguish at a predetermined time, while allowing to be relit at a later time, preserving a wick segment necessary for burning, and not requiring additional effort from operator other than applying additional heat. (Additional effort referring to many of the methods in the prior art that facilitate this process with non-combustible materials that have to be either physically removed—or require a separate wick segment to be recovered from within the wax body.)

Depending on the embodiment a combination of wick type, wax, and additives may be used to determine an approximate burn time of a candle. Once having defined a candle's burn characteristics, a burn rate in length per time can be determined. A time interval can then be set by identifying a start and end position on the wick segment. For example, a cylindrical pillar consisting of a 1.5" diameter and standing 2.5" in height has been determined to have a total burn time of 10 hours. The relationship between candle height by total burn time dictates that the candle is burning 0.25 inches per hour. At this estimated rate, positioning a treated segment on the wick at 1.25" from the top of the candle would provide two burn intervals of approximately 5 hours.

In an exemplary embodiment the timing mechanism is an organic polymeric substance possessing the burn characteristics described above. The organic polymer is created through the hydrolysis of beef fat with caustic soda and potash. The process is essentially a raw version of saponification that produces a substance consisting mainly of fatty acid (FA) and glycerol (with additional unreacted reactants or byproducts). The resulting FA is a malleable solid that can be physically applied to the wick segment at a predetermined length prior to forming the candle. The treated wick is then placed within the mold and the candle is created as is customary. The FA is placed on zinc core wicks and withstands temperatures of 140° F. Paraffin wax is poured in around this combination and hardens to form a votive candle. The amount of FA applied at the designated wick length is approximately 40-55 mg and effectively extinguishes the candle when the flame comes in contact with the FA.

As is common for solid combustibles, the FA burns more effectively when a sufficient specific area ratio is heated. For example, it is easier to start a fire by lighting smaller twigs than a large branch. Similarly, as the flame approaches the FA only a small portion (specifically the top) comes into contact with the flame—thus causing the candle to burnout. The placement of the FA effectively prevents the wicking process stopping the flow of fuel to the flame. Once extinguished, the user can then take a lighter and apply a flame directly to the FA for 5 to 10 seconds, providing enough heat to quench the specific area ratio requirement and reignite the candle. At this point the FA continues to burn away exposing more of the wick beneath and simultaneously relighting the candle wick. By burning away, the wicking process is once again continued and the heat produces by the combusting FA provides a sufficient melted wax pool for further combustion.

One process for creating bead material is as follows.

Gather the following materials:

Raw beef fat (trimmings of fat obtained from butcher)
Tap Water
Potassium Hydroxide (Caustic Potash—solid)—KOH
Sodium Hydroxide (Caustic Soda—solid)—NaOH
Hot plate (stove top)
Strainer
Pipette & Bulb
Stainless Steel Bowl 6" Diameter
Stainless Steel Bowl 4" Diameter
2× Glass Measuring cup (15 oz capacity)
5 lb scale with 0.1 oz sensitivity
Minimum 100 gram scale with 0.001 gram sensitivity
Stainless steel mixing utensil
Stainless steel spoon
Stainless steel ladle
Glass stirrer
Hand and eye protection from corrosive hydroxides
Kettle or heating pot
3× thermometers
plastic storage containers to store up to 4 oz of product
3×250 ml glass beakers
label NaOH soln, KOH soln, and Bi-Product
exacto knife Extract Tallow from Beef Trimmings Add beef fat trimmings into kettle or stainless steel pot and apply gradual heating (approximately 2 lbs of fat trimmings were added per batch—this can vary depending on the fat to beef ratio on the meat samples used)

Maintain fat at approximately 167° F. for a 48 hour period to extract as much liquid tallow from the solid trimmings (required to extract a minimum of 3.2 ounces of liquid fat—depending on fat to beef ratio, may need to add more fat or may have excess)

Allow trimmings to simmer for 48 hour period—fat may be extracted and process continued. Initial mixture—Separate Fatty Acid (Bead Material) from glycerin and water in tallow Weigh out approximately 3.2 ounces of tallow and add to stainless steel bowl (6" diameter).

Place tallow on hot plate and bring up to 170° F.

Place 1 floz. Of water in each of the 250 ml beakers labeled NaOH soln and KOH soln Weigh out 2 oz. of NaOH solid and gradually add to 250 mL glass beaker labeled NaOH soln—containing 1 floz of water. (Provide agitation with glass stirrer until solid has completely dissolved into soln—soln will turn clear, expect soln will heat up to a minimum temp of 150° F.)

Weigh out 2 oz. of KOH solid and add to 250 mL glass beaker labeled KOH soln and containing 1 floz. Of water. (Provide agitation with glass stirrer until solid has completely dissolved into soln—soln will turn clear, expect soln will heat up to a minimum temp of 130° F.)

Simultaneously add the two solutions to your liquid tallow sitting on hot plate and bring entire solution to 170° F. and begin to stir.

Once mixture has reached 170° F., remove from heat source and continue to stir for 12 minutes. (As mixture proceeds to cool, precipitate will begin to form as the fatty acid solidifies and is precipitated out from the mixture). Adequate cooling is dependent on a steady room temperature not to exceed 68° F. Ideally the mixture should slowly cool to room this room temperature.

After 12 minutes of stirring, allow mixture to complete cool to room temperature and sit for 24-30 hour period, leave mixture in stainless steel bowl.

Once mixture has completely solidified and sat for 24 hours at a temperature no greater than 68° F. place mixture back on hotplate.

Begin to apply gradual cooling not to exceed 100° F. This will begin to separate the solid precipitate layer from the glycerol-aqueous layer. Using your pipette and bulb, begin to extract aqueous layer from mixture, leaving only the precipitate.

Some of the aqueous layer will remain but try to remove as much water by allowing continuing to heat and allowing some of the aqueous layer to precipitate. Allow continue heating for a minimum of 15 minutes (may vary depending on how much of the aqueous layer you were able to remove using your pipette). Be sure not to heat to the point that the precipitate begins to degrade Remove precipitate from vessel and place into a clean stainless steel (4") bowl. Continue heating process to remove as much of the aqueous layer as possible. Using a stainless steel spoon press precipitate to squeeze out additional glycerol and press precipitate into a single solid mass.

Remove solid mass from stainless steel (4") bowl and place into a plastic storage container for storage. Do not place lid on plastic bowl until solid mass has cooled to room temperature.

Once solid has cooled to room temperature, affix a lid and allow to sit at room temperature for 48 hours.

Having sat for 48 hours, place into refrigerator (38° F.) for an additional 4 hours.

Use this solid material for bead material.

Different ratios of KOH to NaOH can be used to produce bead material of varying physical properties including overall integrity of material ranging from brittle solid (all NaOH) to malleable semi-solid (all KOH). This particular method prepares a fatty material that is malleable enough to apply bead material to wick by hand.

One process for creating a wick for a 2 inch votive is as follows:

begin with a primed zinc-core wick usually sold in 3 inch length

Cut to exactly 2¼ inches in length from the base clip to the end of wick

Place wick on scale and record weight to the 0.001 grams or 1 mg. Accuracy should be about ±0.005 grams Next mark your wick (measuring from base clip to edge) at 1⅜ inches This mark is the location of the bead consequently the first interval. Add the bead material Using an exacto knife, cut a sliver of material from the solid (fatty acid) mass prepared in the previous instructions.

Using your fingers apply on the marked location of the wick, using your fingers to shape the material into a sphere Place the wick containing the spherically shaped bead onto the scale and record the weight to the 1 mg of accuracy.

Subtract the new weight by the old weight identifying the exact amount of bead material added to the wick. Ideally, you should be at about 30 to 35 mg. Use your exacto knife to remove small amounts of bead to reach goal weight. It is ideal to cut at the base of the bead leaving a mushroom shaped bead rather than cutting at the top.

Having placed bead on wick prepare to prime the treated wick by melting 148° F. paraffin wax. Once wax has cooled to just shy of 148° F., did your treated wick into the wax to add a coat of wax around entire wick.

Your wick is ready to add to candle—be sure wick is not subjected to temperatures exceeding too much higher than 148° F., this will insure your bead stays in place and intact.

Another explanation of the technology disclosed herein is as follows:

1. A self-extinguishing, timed-interval candle wick to automatically interrupt and extinguish the burning process in a candle, the candle wick comprising:

a combustible first wick segment; and a rapidly combustible second wick segment coupled to the combustible first wick segment and located adjacent to or beneath the first wick segment and configured to, as the combustible first wick segment, once ignited, burns down to the rapidly combustible second wick segment, rapidly interrupt and extinguish by vaporization the burning of the first wick segment.

2. The self-extinguishing, timed-interval candle wick to automatically interrupt and extinguish the burning process in a candle of item 1, wherein the combustible first wick segment is configured to be a predetermined length, such that, based on a candle type, length, width, and size, in which the combustible first wick segment is placed, a known burn time is approximated at which point a burning of the combustible first wick segment reaches the rapidly combustible second wick segment and automatically extinguishes, thereby providing the self-extinguishing, timed-interval candle wick with automatic extinguishment at a known, approximated time subsequent to a lighting of the combustible first wick segment.

3. The self-extinguishing, timed-interval candle wick to automatically interrupt and extinguish the burning process in a candle of Item 1, further comprising:

a plurality of combustible first wick segments;

a plurality of rapidly combustible second wick segments interspersed one between each two combustible first wick segments; and wherein the plurality of combustible first wick segments are of generally equal widths and lengths, thereby providing a regular time interval at which the candle wick is automatically extinguished each time the candle is lit.

4. The self-extinguishing, timed-interval candle wick to automatically interrupt and extinguish the burning process in a candle of Item 3, wherein the regular time interval is varied by increasing or decreasing the lengths of the plurality of combustible first wick segments.

5. The self-extinguishing, timed-interval candle wick to automatically interrupt and extinguish the burning process in a candle of Item 3, wherein the candle wick is configured to be relit, post extinguishment by vaporization, without having to physically remove a non-combustible barrier.

6. The self-extinguishing, timed-interval candle wick to automatically interrupt and extinguish the burning process in a candle of Item 1, further comprising:

a rapidly combustible composition;

wherein the rapidly combustible second wick segment is formed by spirally wrapping the rapidly combustible composition around a heat set and subsequently interwoven with the combustible first wick segment at a predetermined location.

7. The self-extinguishing, timed-interval candle wick to automatically interrupt and extinguish the burning process in a candle of Item 1, wherein the rapidly combustible composition comprises magnesium.

8. The self-extinguishing, timed-interval candle wick to automatically interrupt and extinguish the burning process in a candle of Item 1, wherein the rapidly combustible composition comprises a sulfate.

9. The self-extinguishing, timed-interval candle wick to automatically interrupt and extinguish the burning process in a candle of Item 1, wherein the rapidly combustible composition comprises an organic polymer.

10. The self-extinguishing, timed-interval candle wick to automatically interrupt and extinguish the burning process in a candle of Item 9, wherein the organic polymer is a fatty acid created through the hydrolysis of beef fat with caustic soda and potash and wherein the resultant organic polymer is a malleable solid in the form of a bead that is placed upon a combustible first wick segment at a predetermined location.

11. A method for manufacturing a self-extinguishing, timed-interval candle wick to automatically interrupt and extinguish the burning process in a candle, the method comprising:

utilizing a combustible first wick segment;

coupling a rapidly combustible second wick segment to the combustible first wick segment;

locating the rapidly combustible second wick segment adjacent to or beneath the first wick segment; and configuring the rapidly combustible second wick segment to, as the combustible first wick segment, once ignited, burns down to the rapidly combustible second wick segment, rapidly interrupt and extinguish by vaporization the burning of the first wick segment.

12. The method for manufacturing a self-extinguishing, timed-interval candle wick to automatically interrupt and extinguish the burning process in a candle of Item 11, further comprising:

configuring the combustible first wick segment to be a predetermined length, such that, based on a candle type, length, width, and size, in which the combustible first wick segment is placed, a known burn time is approximated at which point a burning of the combustible first wick segment reaches the rapidly combustible second wick segment and automatically extinguishes, thereby providing the self-extinguishing, timed-interval candle wick with automatic extinguishment at a known, approximated time subsequent to a lighting of the combustible first wick segment.

13. The method for manufacturing a self-extinguishing, timed-interval candle wick to automatically interrupt and extinguish the burning process in a candle of Item 11, further comprising:

utilizing a plurality of combustible first wick segments;

utilizing a plurality of rapidly combustible second wick segments and interspersing one rapidly combustible second wick segment between each two combustible first wick segments; and wherein the plurality of combustible first wick segments are of generally equal widths and lengths, thereby providing a regular time interval at which the candle wick is automatically extinguished each time the candle is lit.

14. The method for manufacturing a self-extinguishing, timed-interval candle wick to automatically interrupt and extinguish the burning process in a candle of Item 13, further comprising:

varying the regular time interval by increasing or decreasing the lengths of the plurality of combustible first wick segments.

15. The method for manufacturing a self-extinguishing, timed-interval candle wick to automatically interrupt and extinguish the burning process in a candle of Item 13, further comprising:

configuring the candle wick to be relit, post extinguishment by vaporization, without having to physically remove a non-combustible barrier.

16. The method for manufacturing a self-extinguishing, timed-interval candle wick to automatically interrupt and extinguish the burning process in a candle of Item 11, further comprising:

utilizing a rapidly combustible composition;

forming the rapidly combustible second wick segment by spirally wrapping the rapidly combustible composition around a heat set and subsequently interweaving with the combustible first wick segment at a predetermined location.

17. The method for manufacturing a self-extinguishing, timed-interval candle wick to automatically interrupt and extinguish the burning process in a candle of Item 11, wherein the rapidly combustible composition comprises magnesium.

18. The method for manufacturing a self-extinguishing, timed-interval candle wick to automatically interrupt and extinguish the burning process in a candle of Item 11, wherein the rapidly combustible composition comprises a sulfate.

19. The method for manufacturing a self-extinguishing, timed-interval candle wick to automatically interrupt and extinguish the burning process in a candle of Item 11, wherein the rapidly combustible composition comprises an organic polymer.

20. The method for manufacturing a self-extinguishing, timed-interval candle wick to automatically interrupt and extinguish the burning process in a candle of Item 19, wherein the organic polymer is a fatty acid created through the hydrolysis of beef fat with caustic soda and potash and wherein the resultant organic polymer is a malleable solid in the form of a bead that is placed upon a combustible first wick segment at a predetermined location.

From the foregoing, it will be appreciated that, although specific embodiments of the invention have been described herein for purposes of illustration, various modifications may be made without deviating from the spirit and scope of the invention. For example, many of the features and components described above in the context of a particular timed wick and candle configuration can be incorporated into other configurations in accordance with other embodiments of the invention. Accordingly, the invention is not limited except by the appended claims.

What is claimed is:

1. A self-extinguishing, timed-interval candle wick to automatically interrupt and extinguish the burning process in a candle, the candle wick comprising:

a combustible first wick segment; and a rapidly combustible second wick segment, comprising a rapidly combustible composition, coupled to the combustible first wick segment and located adjacent to or beneath the first wick segment and configured to, as the combustible first wick segment, once ignited, burns down to the rapidly combustible second wick segment, rapidly interrupt and extinguish by vaporization the burning of the first wick segment;

wherein the candle wick is configured to be relit, post extinguishment by vaporization, without having to physically remove a non-combustible barrier.

2. The self-extinguishing, timed-interval candle wick to automatically interrupt and extinguish the burning process in a candle of claim 1, wherein the combustible first wick segment is configured to be a predetermined length, such that, based on a candle type, length, width, and size, in which the combustible first wick segment is placed, a known burn time is approximated at which point a burning of the combustible first wick segment reaches the rapidly combustible second wick segment and automatically extinguishes, thereby providing the self-extinguishing, timed-interval candle wick with automatic extinguishment at a known, approximated time subsequent to a lighting of the combustible first wick segment.

3. The self-extinguishing, timed-interval candle wick to automatically interrupt and extinguish the burning process in a candle of claim 1, further comprising:

a plurality of combustible first wick segments;

a plurality of rapidly combustible second wick segments interspersed one between each two combustible first wick segments; and wherein the plurality of combustible first wick segments are of generally equal widths and lengths, thereby providing a regular time interval at which the candle wick is automatically extinguished each time the candle is lit.

4. The self-extinguishing, timed-interval candle wick to automatically interrupt and extinguish the burning process in a candle of claim 3, wherein the regular time interval is varied by increasing or decreasing the lengths of the plurality of combustible first wick segments.

5. The self-extinguishing, timed-interval candle wick to automatically interrupt and extinguish the burning process in a candle of claim 1, wherein the rapidly combustible second wick segment is formed by spirally wrapping the rapidly combustible composition around a heat set and subsequently interwoven with the combustible first wick segment at a predetermined location.

6. The self-extinguishing, timed-interval candle wick to automatically interrupt and extinguish the burning process in a candle of claim 1, wherein the rapidly combustible composition comprises magnesium.

7. The self-extinguishing, timed-interval candle wick to automatically interrupt and extinguish the burning process in a candle of claim 1, wherein the rapidly combustible composition comprises a sulfate.

8. The self-extinguishing, timed-interval candle wick to automatically interrupt and extinguish the burning process in a candle of claim 1, wherein the rapidly combustible composition comprises an organic polymer.

9. The self-extinguishing, timed-interval candle wick to automatically interrupt and extinguish the burning process in a candle of claim 8, wherein the organic polymer is a fatty acid created through the hydrolysis of beef fat with caustic soda and potash and wherein the resultant organic polymer is a malleable solid in the form of a bead that is placed upon a combustible first wick segment at a predetermined location.

* * * * *